252-99 AU 165 EX
8/17/76 XR 3,975,280

United States Patent [19]
Hachmann et al.
[11] 3,975,280
[45] Aug. 17, 1976

[54] STORAGE-STABLE, READILY-SOLUBLE DETERGENT ADDITIVES, COATING COMPOSITIONS AND PROCESS

[75] Inventors: Klaus Hachmann; Günther Jakobi, both of Hilden; Rudolf Weber, Dusseldorf-Holthausen; Alexander Boeck, Dusseldorf-Vennhausen; Dieter Jung, Hilden, all of Germany

[73] Assignee: Henkel & Cie G.m.b.H., Dusseldorf-Holthausen, Germany

[22] Filed: Mar. 19, 1975

[21] Appl. No.: 559,629

[30] Foreign Application Priority Data

Mar. 21, 1974 Germany ..... 2413561

[52] U.S. Cl. ..... 252/102; 252/89 R; 252/89 B; 252/95; 252/99; 252/106; 252/531; 252/532; 252/550; 252/551; 252/316; 252/DIG. 2; 424/33; 427/212; 427/220; 427/221

[51] Int. Cl.[2] ..... C11D 7/54; C11D 17/00

[58] Field of Search ..... 252/DIG. 2, 12, 99, 252/95, 89, 531, 532, 550, 551, 316, 102; 424/33; 427/220, 221, 212

[56] References Cited

UNITED STATES PATENTS

| | | | |
|---|---|---|---|
| 3,083,172 | 3/1963 | Scott et al. | 252/DIG. 2 X |
| 3,459,665 | 8/1969 | Schiefer et al. | 252/95 |
| 3,637,339 | 1/1972 | Gray | 252/99 X |
| 3,666,680 | 5/1972 | Briggs | 252/DIG. 2 X |
| 3,691,107 | 9/1972 | Erdy et al. | 252/DIG. 2 X |
| 3,723,327 | 3/1973 | Van Kamp et al. | 252/89 X |
| 3,775,537 | 11/1973 | Lehmann et al. | 424/33 X |
| 3,833,506 | 9/1974 | Fries et al. | 252/99 |
| 3,847,830 | 11/1974 | Williams et al. | 252/95 X |
| 3,872,023 | 3/1975 | Baum et al. | 424/33 X |

*Primary Examiner*—Harris A. Pitlick
*Attorney, Agent, or Firm*—Hammond & Littell

[57] ABSTRACT

A storage-stable, readily-soluble detergent additive comprising particles, at least 70% of which have a diameter within the range of 0.1 mm to 1 mm consisting of from 1% to 75% by weight of at least one active material enhancing the washing, bleaching or biocidal effects of a detergent, substantially surrounded by and embedded in from 25% to 99% by weight of an enveloping material consisting of a mixture of A. from 20% to 90% by weight of said mixture of at least one compound having a melting point above 30°C, selected from the group consisting of fatty acids and fatty alcohols, B. from 0 to 50% by weight of said mixture of at least one water-soluble compound selected from the group consisting of poly-oxy-lower alkylene glycols, non-ionic surface-active compounds and anionic surface-active compounds, and C. from 1% to 40% by weight of said mixture of at least one water-insoluble but water-swellable compound selected from the group consisting of salts of acrylic acid copolymers and methacrylic acid copolymers. The invention also relates to the method of producing the particles and the enveloping material. The particles are obtained by spraying a fluid mixture of the components through a nozzle or by a spray disc, and cooling. The stabilized particles of active materials can be incorporated with percompounds and other washing composition components.

16 Claims, No Drawings

STORAGE-STABLE, READILY-SOLUBLE DETERGENT ADDITIVES, COATING COMPOSITIONS AND PROCESS

THE PRIOR ART

Washing compositions with a content of granulates are known, which granulates consist of an extrudible solid and a substance that is embedded and enveloped in the solid and protected from decomposition. Among the substances to be protected from decomposition are, for example, optical brighteners, germicides, enzymes, odorants or perfumes, and bleaching activators, that is materials which are not limitlessly resistant to atmospheric oxygen, alkalis, or bleaching agents. The protective extrudible agents used for the embedding consist, for example, of fatty acids, polyglycols, soap, and other anionic or especially non-ionic tensides or surface-active compounds as well as of starch swollen in water, gelatin, and cellulose derivatives. However, it became evident that the stability and the dissolving properties of such granulates were not satisfactory in many instances. When enzymes are used, and especially when bleaching activators are used, embedding materials that are water-soluble or permeable to water vapor, for example, polyglycols, cellulose derivatives and starch derivatives as well as tensides exert a protective effect which is usually insufficient if at the same time, the detergent contains compounds having a bleaching effect, such as for example, perborates. Enveloping substances that are water-insoluble or impermeable to water vapor, such as fatty acids or fatty alcohols do not dissolve or only dissolve slowly in cold or moderately hot washing liquors, for example, those under 60°C, so that the embedded agent is not liberated to the required extent or within the time available for the washing process. The undissolved particles can be deposited on the washed textile fabric and lead to the formation of spots.

Furthermore, it is known that bleaching activators can be protected from decomposition in washing compositions containing bleaching agents through a coating of the bleaching activators with fatty acids, polyglycols, water-soluble polymers, fatty alcohols and fatty acid alkanolamides. However, effective protection is only accomplished when as described above, water-impermeable enveloping materials are employed and when the particles are completely enveloped. Upon dissolution, the same difficulties are encountered as described above.

In U.S. Pat. No. 3,789,002 solid, pulverulent to granular compositions used for the preparation of aqueous cold-bleaching washing liquors for textiles are disclosed comprising from 5% to 100% by weight of an activator component consisting of an activator for per-compounds in the form of particles surrounded with a coating substance inert to the activator, selected from the group consisting of water-soluble compounds and water-insoluble compounds, said activator constituting from 5% to 50%, preferably 15% to 40% by weight, and said coating substance constituting from 50% to 95%, preferably 60% to 85% by weight, of the activator component, the coating substance being bound to activator by forces selected from the group consisting of surface forces and water of crystallization.

In copending, commonly-assigned U.S. patent application Ser. No. 382,595, filed July 25, 1973, now U.S. Pat. No. 3,925,234 a stabilized bleaching assistant suitable for use in pulverulent washing and bleaching compositions is disclosed comprising drop-shaped to globular-shaped particles at least 70% of which have a diameter within the range of 0.1 mm to 1 mm consisting of 10% to 70% by weight of at least one activator for active oxygen derived from compounds yielding $H_2O_2$ in aqueous solution, substantially surrounded by from 30% to 90% by weight of a mixture of (a) from 2 to 10 parts of substantially saturated fatty acids having 12 to 24 carbon atoms and (b) 1 part of aliphatic alcohols having 10 to 20 carbon atoms or their lower alkoxylated products having 1 to 5 alkoxy units.

In another previous U.S. Pat. No. 3,833,506 a bleaching auxiliary is described which consists of small, spherical to drop-like particles and which is composed of higher-melting, essentially saturated fatty acids, water-soluble polyglycols, and a bleaching activator embedded therein. This bleaching auxiliary was prepared by spraying the molten mixture by means of an atomizing disk or nozzle into which cold air is fed. These products show high stability in storage and are sufficiently soluble in hot washing liquors.

OBJECTS OF THE INVENTION

An object of the present invention is the improvement of the properties of the washing composition auxiliaries and especially the properties of the embedding or enveloping materials so that the embedded agent is effectively protected from decomposition, even in the case of unfavorable storing conditions, and that this agent is completely liberated within a short time in cold water or cold washing liquors.

Another object of the present invention is the development of a storage-stable, readily-soluble detergent additive comprising particles, at least 70% of which have a diameter within the range of 0.1 mm to 1 mm consisting of from 1% to 75% by weight of at least one active material enchancing the washing, bleaching or biocidal effects of a detergent, substantially surrounded by and embedded in from 25% to 99% by weight of an enveloping material consisting of a mixture of A. from 20% to 90% by weight of said mixture of at least one compound having a melting point above 30°C, selected from the group consisting of fatty acids and fatty alcohols, B. from 0 to 50% by weight of said mixture of at least one water-soluble compound selected from the group consisting of poly-oxy-lower alkylene glycols, non-ionic surface-active compounds and anionic surface-active compounds, and C. from 1% to 40% by weight of said mixture of at least one water-insoluble but water-swellable compound selected from the group consisting of salts of acrylic acid copolymers and methacrylic acid copolymers.

A further object of the present invention is the development of an enveloping material composition consisting of a mixture of A. from 20% to 90% by weight of said mixture of at least one compound having a melting point above 30°C, selected from the group consisting of fatty acids and fatty alcohols, B. from 0 to 50% by weight of said mixture of at least one water-soluble compound selected from the group consisting of poly-oxy-lower alkylene glycols, non-ionic surface-active compounds and anionic surface-active compounds, and C. from 1% to 40% by weight of said mixture of at least one water-insoluble but water-swellable compound selected from the group consisting of salts of acrylic acid copolymers and methacrylic acid copolymers.

A yet further object of the present invention is the development of a process for the production of the above storage-stable, readily soluble detergent additive which consists of dispersing solid particles of said active material enhancing the washing, bleaching or biocidal effects of a detergent in a melt of said enveloping material mixture, forming droplets of said dispersion at least 70% of which have a diameter within the range of 0.1 mm to 1 mm by means selected from the group consisting of (1) pressure spraying through a nozzle having an opening having a diameter of from 0.3 mm to 2.5 mm at a pressure of from 10 to 30 kg/cm² and (2) spraying from a spray disc rotating at a peripheral speed of from 5 to 150 m/sec, and cooling said droplets without contact below their solidifying temperature.

These and other objects of the invention will become more apparent as the description thereof proceeds.

DESCRIPTION OF THE INVENTION

According to the present invention, there is provided a detergent additive which is readily soluble in aqueous washing liquors, stable in storage, and present in form of particles containing an active material which strengthens the washing, bleaching, or biocidal effects of the detergent and which is embedded in an enveloping material, characterized in that the enveloping material consists of a mixture of the following components:

A. from 20% to 90% by weight of said mixture of at least one compound having a melting point above 30°C chosen from the class of fatty acids and fatty alcohols, B. from 0 to 50% by weight of said mixture of at least one water-soluble compound chosen from the class of polyglycols and non-ionic and anionic surface-active compounds, C. from 1% to 40% by weight of said mixture of a substance which is insoluble in water, but capable of swelling in water, which substance is chosen from the class of salts of acrylic acid copolymers and methacrylic acid copolymers.

More particularly the invention relates to a storage-stable, readily-soluble detergent additive comprising drop-shaped to globular-shaped particles, at least 70% of which have a diameter within the range of 0.1 mm to 1 mm consisting of from 1% to 75% by weight of at least one active material enhancing the washing, bleaching or biocidal effects of a detergent selected from the group consisting of (1) 10% to 70% by weight of at least one compound from the class of N-acyl and O-acyl compounds as well as carbonic acid esters and pyrocarbonic acid esters which act as an activator for percompounds, the activation value of which for the percompounds amounts to more than 3 in the Per-Acid Formation Test, (2) 1% to 75% by weight of at least one enzyme selected from the group consisting of proteases, amylases, lipases and mixtures thereof, (3) 1% to 60% by weight of at least one optical brightener, (4) 1% to 60% by weight of at least one biocide and (5) 1% to 30% by weight of at least one perfume or odorant, said at least one active material being substantially surrounded by and embedded in from 25% to 99% by weight of an enveloping material consisting of a mixture of A. from 20% to 90% by weight of said mixture of at least one compound having a melting point above 30°C, selected from the group consisting of (i) saturated fatty acids having from 10 to 24 carbon atoms, saturated hydroxy fatty acids having from 10 to 24 carbon atoms and mixtures of said fatty acids and hydroxy fatty acids with up to 20% by weight of unsaturated higher fatty acids and saturated fatty acids having 8 to 10 carbon atoms, and (ii) saturated fatty alcohols having from 12 to 24 carbon atoms, and (iii) mixtures of said acids (i) and said alcohols (ii) in a weight ratio of from 4:1 to 1:1, B. from 10% to 40% by weight of said mixtures of at least one water-soluble compound having a melting point above 30°C, selected from the group consisting of poly-oxy-lower alkylene glycols having a molecular weight of from 1000 to 20,000, non-ionic surface-active compounds and anionic surface-active compounds of the sulfonate and sulfate types, said components (A) and (B) being present in a weight ratio of from 10:1 to 1:2, and C. from 1% to 40% by weight of said mixture of at least one water-insoluble, but water swellable compound capable of absorbing more than 500% by weight of water, based on its dry weight, and having an average particle size in the range of from 0.001 mm to 1 mm selected from the group consisting of (a) the alkali metal salts of copolymers of acrylic acid and from 2 to 25 mol percent of cross-linking monomers copolymerizable with acrylic acid and having more than one polymerizable double bond, (b) the alkali metal salts of copolymers of methacrylic acid and from 2 to 25 mol percent of cross-linking monomers copolymerizable with methacrylic acid and having more than one polymerizable double bond, and (c) mixtures of said salts.

Suitable fatty acids which are present in component (A) of the enveloping material mixture are saturated fatty acids and saturated hydroxyfatty acids having 10 to 24 carbon atoms as well as their mixtures, such as capric acid, lauric acid, myristic acid, palmitic acid, stearic acid, arachidic acid, behenic acid and lignoceric acid, as well as hydroxystearic acid and dihydroxystearic acid. When mixtures of naturally occurring or hydrogenated fatty acids are used, these mixtures can also contain saturated fatty acids having 8 to 10 carbon atoms or unsaturated fatty acids with 8 to 24 carbon atoms, for example, oleic acid; however, the amount of lower molecular-weight or unsaturated acids should be less than 20% by weight, especially less than 10% by weight of the total amount of fatty acids present. The fatty acid mixture should have such a composition that the softening point or the melting point lies above 30°C preferably above 38°C.

In the component (A) of the enveloping material mixture fatty alcohols or fatty alcohol mixtures having 12 to 24 carbon atoms can replace the fatty acids or preferably, they can can be present mixed with these fatty acids. Especially suitable are saturated aliphatic monohydric fatty alcohols or alkanols having from 10 to 20 carbon atoms such as lauryl alcohol, myristyl alcohol, cetyl alcohol and stearyl alcohol as well as their mixtures, for example, hydrogenated coconut or tallow fatty alcohols. If mixtures with fatty acids are used, the ratio by weight of fatty alcohol to fatty acid in component (A) should preferably be 1:4 to 1:1, in particular, 1:3 to 2:3. In that case, the composition should be so chosen that the melting point lies above 30°C, preferably above 38°C.

Suitable compounds for the component (B) of the enveloping material mixture are the water-soluble poly-oxy-lower alkylene glycols, preferably polyoxyethylene glycols and water-soluble mixed polyoxyethylene-polyoxypropylene glycols, which melt at a temperature above 30°C and possess a molecular weight of 1,000 to 20,000, preferably 2,000 to 10,000. Plastifiable anionic and/or non-ionic surface-active compounds can replace the polyoxy-lower alkylene glycols or can be used mixed with the latter. Suitable anionic surface-active compounds comprise first of all fatty alcohol sulfates and lower alkoxylated fatty alcohol ether sulfates which are derived from saturated or unsaturated fatty alcohols having 12 to 18 carbon atoms and in the case of the lower alkoxylated ether sulfates, contain 1 to 4, preferably 2 oxyethyl ether groups. Additional usable anionic surfactants are the alkylbenzene-sulfonates having linear $C_9$ to $C_{14}$ alkyl groups, olefinsulfonates which can be prepared from primary $C_{12}$ to $C_{18}$ olefins by sulfonation with $SO_3$, followed by alkaline hydrolysis, as well as $\alpha$-sulfofatty acid esters which are derived from saturated $C_{10}$ to $C_{18}$ fatty acids esterified with $C_1$ to $C_3$ alkanols and $\alpha$-sulfonated. The anionic surface-active compounds are preferably present as sodium salts.

Eligible non-ionic surface-active compounds suitable for use in the component (B) of the enveloping material mixture are, first of all, mono-ethers of poly-oxy-lower alkylene glycols which are derived from fatty alcohols, fatty acids, fatty acid amides, and alkyylphenols and which contain 3 to 30 oxyethylene groups and 8 to 20 carbon atoms in the hydrocarbon residue. Especially suitable are derivatives in which the number of oxyethylene groups is 5 to 13 and the hydrocarbon residues are derived from straight-chain primary alkanols having 12 to 18 carbon atoms or are derived from alkylphenols having 8 to 14 carbon atoms in the alkyl chain.

If mixtures of poly-oxy-lower alkylene glycols and anionic or non-ionic surface-active compounds are employed, the ratio by weight of poly-oxy-lower alkylene glycol to surface-active compounds can be 10:1 to 1:5. The amount of the component (B) in the enveloping material mixture is preferably 10% to 40% by weight and the ratio by weight of component (A) to component (B) is preferably 10:1 to 1:2, especially 5:1 to 1:1.

The water absorption or swelling power of the copolymers to be used as component (C) of the enveloping material mixtures amounts to more than 500%, preferably 600% to 6,000%, based on the weight of the dry substance. This is to be distinguished from the customary polyacrylates where this power mostly lies at 150% to 300% in the case of the customary polyacrylates used as ion exchange resins. The water absorption power is determined by allowing a weighed quantity of copolymer to swell in distilled water until saturation is reached. Therefor the material is filtered by means of a paper filter. The copolymers remain on the filter until no more water runs off and are then weighed. The weight increase in percent, based on the anhydrous material, indicates the water absorption power.

The particle size of the copolymers in the dry state advantageously is from 0.001 mm to 1.0 mm whereby at the most, 50% by weight of the particles should have a size of more 0.5 mm. The average particle size preferably lies between 0.01 and 0.3 mm.

The water-insoluble copolymers capable of swelling in water which are to be used according to the invention can be very uniformly suspended in water or washing liquors, hence, they do not settle on the textile fiber or textile fabric and can be easily and completely removed upon rinsing. The sedimentation rate of the suspension is correspondingly low so that no residues deposit on the bottom of the liquor holding tank or in drain pipes and sewer pipes.

For the manufacture of the copolymers, a process known per se is used. Acrylic acid or methacrylic acid are copolymerized in the presence of unsaturated copolymerizable compounds containing multiple double or ethylenic bonds and in the presence of a solvent which, optionally, has been solifified, such as by freezing, before the polymerization, or in the presence of a blowing agent.

Usable unsaturated compounds containing multiple ethylenic bonds which copolymerize and cross-link with the above-named unsaturated carboxylic acids are aliphatic, cycloaliphatic, and aromatic diolefins, for example, butadiene or divinylbenzene, furthermore, polyunsaturated ethers and esters for example, di-lower alkenyl ethers and di-lower alkenyl ethers of lower alkylene glycols such as divinyl ether, diallyl ethers of ethylene glycols, esters of acrylic acid and methacrylic acid with dihydric and polyhydric alcohols, for example, lower alkanediols and lower alkanepolyols such as ethylene glycol diacrylate, or those from vinyl alcohol or allyl alcohol and polybasic carboxylic acids, for example, di-lower alkenyl esters of alkanedioic acids, and alkenedioic acids, such as divinyl oxalate and divinyl maleate and in addition, those from unsaturated alcohols with unsaturated acids, for example, lower alkenyl lower alkenoates, such as vinyl acrylate or allyl methacrylate. Other eligible compounds are diamides, for example, those prepared from lower alkenoic acids and lower alkylene diamine for example, acrylic acid or methacrylic acid and diamines, such as ethylenebis(acrylamide). Also usable are polymers containing at least two polymerizable double bonds, for example, unsaturated polyesters of maleic acid and lower alkane diols. In general, the amount of the unsaturated compounds containing multiple ethylenic bonds is 2 to 25, especially 4 to 15 mol percent.

To modify the properties of the polyacrylates or polymethacrylates, additional compounds copolymerizable with acrylic or methacrylic acids, for example, crotonic acid or unsaturated polycarboxylic acids, for example lower alkenepolyoic acids such as maleic acid, fumaric acid, itaconic acid, measaconic acid, citraconic acid, aconitic acid, 1-butene-2,3,4-tricarboxylic acid, furthermore, ethers and esters of vinyl alcohol or allyl alcohol, for example, alkyl lower alkenyl ethers or lower alkenyl lower alkanoates such as vinyl methyl ether, or vinyl acetate, vinylpyrrolidone, monounsaturated aromatic hydrocarbons, such as styrene or vinyltoluene, as well as prepared polymers and copolymers containing residual double bonds, such as polyacrylic acid or copolymers of acrylic acid with one or more of the above-named vinyl or divinyl compounds, for example, those from acrylic acid, styrene, and butyl acrylate or butylene glycol diacrylate can be added to the starting monomers. These are ordinarily added in amounts of from 0 to 20% by weight of the monomers.

The polymerization, which is initiated by free-radicals in a conventional manner is so carried out that the products possess high swelling power. This can be attained, for example, by polymerization in a solvent or in an aqueous dispersion. The solvent or the dispersion can be allowed to solidify by cooling whereby a crystalline matrix is formed which results in a porous or sponge-like to foam-like structure of the polyacrylate. The swelling resulting in foam-like structures can be also effected by the use of volatile blowing agents, such as air, water vapor, low-boiling solvents, or reagents evolving gases, or by heating or decompression. Customary auxiliaries promoting the foam formation such as surface active materials or agents increasing the viscosity can also be present. The foaming is so generated that substantially, open-cellular foams are formed.

If the copolymers are not already present as salts, it is advantageous to convert them into alkali metal salts, preferably into sodium salts. The optionally present solvents are removed and the polymers are dried and ground to powder or flakes having the above-stated particle size.

The amount of the component (C) in the enveloping material mixture is preferably 2% to 20% by weight.

Active agents which together with the above-named components are worked up to form homogeneous particles include bleaching activators, enzymes, optical brighteners, biocides, as well as odorants. Preferred ingredients are bleaching activators and enzymes.

Preferably, the invention comprises a stabilized bleaching assistant suitable for use in pulverulent washing and bleaching compositions comprising drop-shaped to globular-shaped particles at least 70% of which have a diameter within the range of 0.1 mm to 1 mm consisting essentially of 10% to 70% by weight of at least one activator for active oxygen derived from compounds yielding $H_2O_2$ in aqueous solutions having an activating action of least 3 in the Per-Acid Formation Test selected from the group consisting of N-acyl compounds having 2 to 9 carbon atoms in the acyl, O-acyl compounds having 2 to 9 carbon atoms in the acyl, carbonic acid esters and pyrocarbonic acid esters, substantially surrounded by from 30% to 90% by weight of an enveloping material consisting of a mixture of A. from 20% to 90% by weight of said mixtures of at least one compound having a melting point above 30°C, selected from the group consisting of (i) saturated fatty acids having from 10 to 24 carbon atoms, saturated hydroxyfatty acids having from 10 to 24 carbon atoms and mixtures of said fatty acids and hydroxyfatty acids with up to 20% by weight of unsaturated higher fatty acids and saturated fatty acids having 8 to 10 carbon atoms, (ii) saturated fatty alcohols having from 12 to 24 carbon atoms, and (iii) mixtures of said acids (i) and said alcohols (ii) in a weight ratio of from 4:1 to 1:1, B. from 10% to 40% by weight of said mixture of at least one water-soluble compound having a melting point above 30°C, selected from the group consisting of poly-oxy-lower alkylene glycols having a molecular weight of from 1000 to 20,000, non-ionic surface-active compounds and anionic surface-active compounds of the sulfonate and sulfate types, said components (A) and (B) being present in a weight ratio of from 10:1 to 1:2, and C. from 1% to 40% by weight of said mixture of at least one water-insoluble, but water swellable compound capable of absorbing more than 500% by weight of water based on its dry weight, and having an average particle size in the range of from 0.001 mm to 1 mm, selected from the group consisting of (a) the alkali metal salts of copolymers of acrylic acid and from 2 to 25 mol percent of cross-linking monomers copolymerizable with acrylic acid and having more than one polymerizable double bond, (b) the alkali metal salts of copolymers of methacrylic acid and from 2 to 25 mol percent of cross-linking monomers copolymerizable with methacrylic acid and having more than one polymerizable double bond, and (c) mixtures of said salts.

The bleaching assistants are preferably present in the mixture together with further pulverulent bleaching agent components, especially granular to pulverulent percompounds which liberate hydrogen peroxide in aqueous solution. In these mixtures the proportion by weight of the bleaching assistant to the percompound should amount to 1:5 to 5:1 and be chosen so that 0.05 to 2 mols of activator are present per gram atom of active oxygen. These solid, pulverulent-to-granular compositions useful in the preparation of aqueous cold-bleaching baths, especially cold-bleaching washing liquors for textile consist essentially of (I) from 5% to 95% by weight of the above stabilized bleaching assistant, and (II) from 5% to 95% by weight of at least one compound selected from the group consisting of (a) alkali metal builder salts, (b) percompounds giving $H_2O_2$ in aqueous solutions and stabilizers for percompounds, (c) tensides selected from the group consisting of anionic surface-active compounds, non-ionic surface-active compounds and amphoteric surface-active compounds, (d) optical brighteners, (e) water-soluble organic builder salts, (f) antimicrobial agents, (g) soil suspension agents, (h) enzymes, (i) foam inhibitors, (k) textile softeners, and (l) corrosion inhibitors.

The activators for percompounds utilizable according to the invention are certain compounds of the N-acyl and O-acyl type as well as carbonic acid esters of pyrocarbonic acid esters, indicated below under (a) to (o), which have an activation value in the Per-Acid Formation Test of at least 3, preferably at least 4.5.

PER-ACID FORMATION TEST

The activation value (= titre) for the activators is determined in the following way:

Solutions which contain 0.615 gm/liter of $NaBO_2 \cdot H_2O_2 \cdot 3H_2O$ (4 mMol/liter) and 2.5 gm/liter of $Na_4P_2O_7 \cdot 10\ H_2O$, are heated to 60°C, and then are mixed with 4 mMol/liter of activator and maintained at the said temperature for 5 minutes with stirring. Then 100 ml of this liquid is added to a mixture of 250 mg of ice and 15 ml of glacial acetic acid and titrated immediately after addition of 0.35 gm of potassium iodide with 0.1 N sodium thiosulfate solution, using starch as indicator. Under the given experimental conditions, for a 100% activation of the peroxide used, 8.0 ml of thiosulfate solution are consumed, the titre is 8.0. This maximum value is, of course, seldom attained. Good activators have a titre of at least 4.5, preferably from 5 to 7. Useful results are often obtained with activators having a titre of at least 3.0.

Activators of the N-acyl or O-acyl compounds type contain an acyl residue R—CO—, in which R represents optionally substituted hydrocarbon residues with 1 to 8 carbon atoms. If the residues R are aliphatic, they preferably have 1 to 3 carbon atoms, and if they are aromatic, they may contain up to 8 carbon atoms. Consequently, the residue R is preferably one of the following: lower alkyl, such as methyl, ethyl, n-propyl or isopropyl; phenyl; alkylphenyl such as toluyl or xylyl residues. Suitable substituents for both aliphatic and aromatic residues are $C_{1-3}$ alkoxy groups, halogen atoms, nitro or nitrile groups; when R is an aromatic residue, it may be chloro and/or nitro-substituted, especially m-chloro or m- or p-nitro-substituted. Such substituted R residues are, for example, chloroalkyl having 1 to 3 carbon atoms, m-chlorophenyl, p-nitrophenyl, and p-methoxyphenyl.

Of the activators described below, compounds with a melting point of at least 70°C, preferably at least 100°C and especially at least 150°C, are specially suitable. Furthermore, the equivalent weight of these compounds should be not more than 170, preferably not more than 130 and especially not more than 110 (the equivalent weight is here the quotient of the molecular weight and the number of R—CO—residues present in the molecule where the compound is N-acylated or O-acylated, or the number of carbonic acid residues or pyrocarbonic acid residues in the molecules).

The types of compound mentioned under (a) to (o) are useful activators according to the invention. In the formulae the numbered residues R have the meaning given for R above unless specifically otherwise indicated. If several residues R are present in a molecule, they may be the same or different.

a. N-diacylated amines of the formula I, in which X represents a residue R or one of the residues Ia, Ib, or Ic.

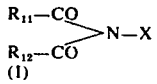

(I)

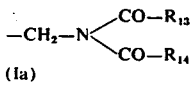

(Ia)

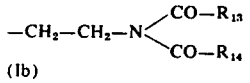

(Ib)

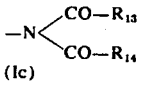

(Ic)

From this class of compounds, N,N,N′,N′-tetraacetylmethylenediamine (melting point 92° to 95°C), N,N,N′,N′-tetraacetylethylenediamine, N,N-diacetylaniline and N,N-diacetyl-p-toluidine are named as examples.

b. N-acylhydantoins of formula II, in which at least one of the residues $X_{21}$ and $X_{22}$ represent an R—CO—residue, while the other may also represent a residue R or a carboxymethyl or a lower alkoxycarbonylmethyl residue; $Y_{21}$ and $Y_{22}$ represent hydrogen or alkyl residues with 1 to 2 carbon atoms.

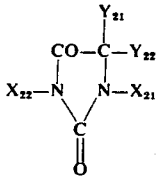

(II)

Suitable compounds are, for example, 1,3-diacetyl-5,5-dimethylhydantoin, 1,3-dipropionylhydantoin (melting point 104.5° to 106°C) and 3-benzoylhydantoin-1-acetic acid ethyl ester.

c. N-alkyl-N-sulfonyl-carbonamides of formula III, in which $R_{33}$ preferably signifies a $C_{1-3}$ alkyl residue.

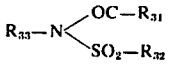

(III)

Activators of this type are, for example N-methyl-N-mesylacetamine (melting point 73° to 79°C), N-methyl-N-mesylbenzamide (melting point 116° to 118.5°C), N-methyl-N-mesyl-p-nitrobenzamide (melting point 159° to 160°C) and N-methyl-N-mesyl-p-methoxybenzamide (melting point 117° to 117.5°C).

d. Cyclic N-acylhydrazides of formula IV, in which the two nitrogen atoms are part of a 5- or 6-membered hetero ring from the group of maleic acid hydrazide, phthalic acid hydrazide, triazole or urazole.

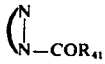

(IV)

A suitable compound, for example, is mono-acetylmaleic acid hydrazide.

e. O,N,N-trisubstituted hydroxylamines of formula V, in which $R_{53}$ represents a residue R, preferably a methyl or ethyl residue, an optionally substituted aryl residue or the group Va, while $X_{51}$ and $X_{52}$ represent one of the residues R—CO—, R—$SO_2$— or one of the above-described aromatic residue, or each can be linked with the corresponding residue $R_{51}$ or $R_{52}$ to give a succinyl or phthalyl residue and *n* signifies a whole number from 0 to 2.

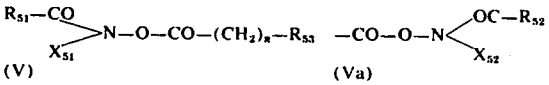

(V) (Va)

Activators of this type are, for example, O-benzoyl-N,N-succinyl-hydroxylamine (melting point 137° to 139°C), O-acetyl-N,N-succinyl-hydroxylamine (melting point 132° to 134°C), O-p-methoxybenzoyl-N,N-succinyl-hydroxylamine (melting point 142° to 145°C), O-p-nitrobenzoyl-N,N-succinyl-hydroxylamine (melting point 212° to 215°C) and O,N,N-triacetyl-hydroxylamine.

f. N,N′-diacyl-sulfurylamides of formula VI, in which $R_{61}$ and $R_{63}$ preferably represent $C_{1-4}$ alkyl residues or aryl residues such as phenyl, while $R_{62}$ and $R_{64}$ preferably represent $C_{1-5}$ alkyl residues, especially $C_{1-3}$ alkyl residues.

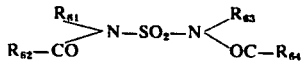

(VI)

N,N′-dimethyl-N,N′-diacetyl-sulfurylamide (melting point 58° to 60°C) and N,N′diethyl-N,N′-dipropionyl-sulfurylamide (melting point 95° to 97°C) may be mentioned as examples. g. Triacyl-cyanurates of formula VII

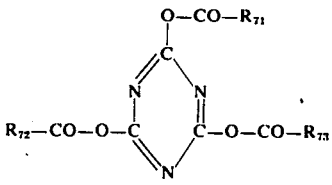

(VII)

where $R_{71}$, $R_{72}$ and $R_{73}$ are R, for example, triacetyl or tribenzoyl-cyanurate.

h. Optionally substituted anhydrides of benzoic or phthalic acids, especially benzoic acid anhydride itself, m-chlorobenzoic acid anhydride (melting point 95°C), phthalic acid anhydride or 4-chlorophthalic acid anhydride.

i. Sugar esters esterified with two or more acyls, OC—R, for example, glucosepentaacetate.

j. 1,3-Diacyl-4,5-diacyloxy-imidazolidines of formula VIII in which $X_{80}$ represents hydrogen, or R, and $R_{80}$ and $R_{83}$ represent hydrogen or R.

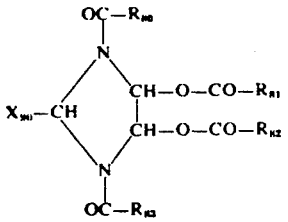

(VIII)

To these belong 1,3-diformyl-4,5-diacetoxy-imidazolidine (melting point 160° to 165.5°C), 1,3-diacetyl-4,5-diacetoxy-imidazolidine (melting point 139° to 140.5°C), 1,3-diacetyl-4,5-dipropionyloxy-imidazolidine (melting point 85° to 87°C).

k. Acylated glycolurils of the general formula IX, in which $X_{91}$ represents the residue R or R—CO.

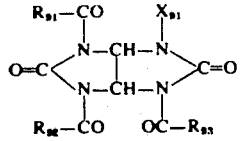

(IX)

tetraacylated glycolurils and especially tetraacetylglycoluril (melting point 233° to 240°C) are preferably used. In addition, the following acylated glycolurils are suitable:

di-(chloracetyl)-diacetyl-glycoluril (melting point 267° to 269°C), tetrapropionyl-glycoluril (melting point 144° to 146°C), 1-methyl-3,4,6-triacetylglycoluril (melting point 179° to 180°C), diacetyl-dipropionyl-glycoluril (melting point 144° to 146°C), and diacetyl-dibenzoylglycoluril (melting point 244° to 249°C). The acylated glycolurils are not only of special practical importance on account of their excellent properties as activators, but owing to their high melting point, they are very suitable for the preparation of pulverulent products which are stable on storage.

l. Diacylated 2,5-diketopiperazines of the general formula X

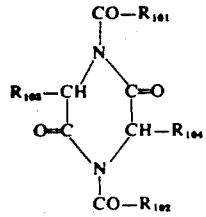

(X)

in which $R_{101}$ and $R_{102}$ are R and $R_{103}$ and $R_{104}$ are hydrogen, alkyl having 1 to 3 carbon atoms, hydroxyalkyl having 1 to 3 carbon atoms, haloalkyl having 1 to 3 carbon atoms, nitroalkyl having 1 to 3 carbon atoms, nitriloalkyl having 2 to 4 carbon atoms and alkoxyalkyl having 2 to 5 carbon atoms, for example: 1,4-diacetyl-2,5-diketopiperazine, 1,4-dipropionyl-2,5-diketopiperazine (melting point 113° to 114.5°C) and 1,4-dipropionyl-3,6-dimethyl-2,5-diketopiperazine (melting point 113° to 114°C).

m. N-acylated 2,4,6,8-tetraaza-bicyclo-(3,3,1)-nonan-3,7-diones of the general formula XI

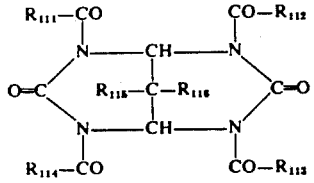

(XI)

in which $R_{111}$, $R_{112}$, $R_{113}$ and $R_{114}$ are R and $R_{115}$ and $R_{116}$ are hydrogen or methyl, for example: 2,4,6,8-tetraacetyl-2,4,6,8-tetraaza-bicyclo-(3,3,1)-nonan-3,7-dione (melting point 181° to 183°C), 2,4,6,8-tetrapropionyl-2,4,6,8-tetraaza-bicyclo-(3,3,1)-nonan-3,7-dione (melting point 144.5° to 146°C), 2,4,6,8-tetraacetyl-9,9-dimethyl-2,4,6,8tetraaza-bicyclo-(3,31)-nonan-3,7-dione (melting point 180° to 183°C), and 2,4,6,8-tetrabenzoyl-2,4,6,8-tetraaza-bicyclo-(3,3,1)-nonan-3,7-dione (melting point 234° to 236.5°C).

n. Carbonic acid esters of formula XII as described in German Application DOS No. 1,444,024, in which $X_{121}$ represents an electron-attracting residue, preferably selected from the group p-carboxyphenyl, p-sulfophenyl or alkoxycarbonyl with 1 to 4 carbon atoms in the alkoxy group:

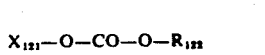

(XII)

For example, the sodium salts of p-ethoxycarbonyloxybenzoic acid (melting point 157°C) and p-propoxycarbonyloxy-benzene sulfonic acid.

o. Pyrocarbonic acid esters of $C_1$ to $C_4$ alkanols, as for example, pyrocarbonic acid ethyl ester.

Tetraacetylglycoluril mentioned uner (j) is of particular interest.

In the activation of the percompounds in aqueous solutions by the said N-acyl and O-acyl compounds, carboxylic acids as, for example, acetic acid, propionic acid and benzoic acid, are liberated and it is advisable to add corresponding amounts of alkali to bind these carboxylic acids. In the case of effective activators, an activation is already to be noted when amounts of 0.05 mol of activator per gram atom of active oxygen are used. It is preferred to work with 0.1 to 1 mol of activator, but the amount may also be increased to 2 mols of activator per gram atom of active oxygen.

The particular detergent additives should not contain more than 75% by weight of bleaching activators. Preferably, this content is 30% to 70% by weight and in particular from 30% to 60% by weight.

The optical brighteners which may be embedded in the enveloping material mixture of the invention are especially the derivatives of diaminostilbenedisulfonic acid or their alkali metal salts of the formula

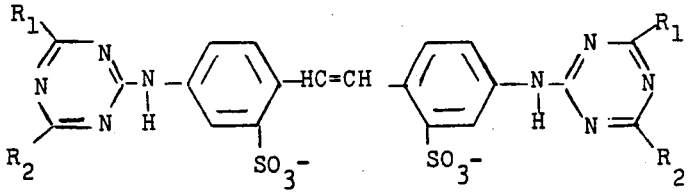

wherein $R_1$ and $R_2$ may represent halogen atoms, lower alkoxy groups, the amino group or radicals of aliphatic, aromatic or heterocyclic primary or secondary amines as well as radicals of aminosulfonic acids where the aliphatic radicals, present in the above groups, contain preferably 1 to 4, and particularly 2 to 4 carbon atoms, while the heterocyclic ring systems are primarily rings with 5 or 6 members. As aromatic amine radicals preferably aniline, anthranilic acid or anilinesulfonic acid are of interest. Brighteners derived from the diaminestilbene sulfonic acids are mostly used as brighteners for cotton. The following products, derived from formula I, are commercially available, where $R_1$ represents the residue $—NH—C_6H_5$ and $R_2$ represents the following:

$—NH_2$
$—NH—CH_3$
$—NH—CH_2—CH_2OH$
$—NH—CH_2—CH_2—O—CH_3$
$—NH—CH_2—CH_2—CH_2—O—CH_3$
$CH_3—N(—)—CH_2—CH_2OH$
$—N=(CH_2—CH_2OH)_2$
morpholino-
$—NH—C_6H_5$
$—NH—C_6H_4—SO_3H$
$—OCH_3$ For example, salts of 4,4'-bis-(2''-anilino-4''-morpholino-1,3,5-triazinyl-6''-amino)-stilbene-2,2'-disulfonic acid, or similarly constructed compounds, which instead of the morpholino group contain a diethanolamine group, a methylamino group or a β-methoxyethylamine group are suitable. Furthermore, suitable brighteners for polyamide fibers are those of the diarylpyrazoline type, for example, 1-(p-sulfonamidophenyl)3-(p-chlorophenyl)-$\Delta^2$-pyrazoline, as well as similarly constructed compounds which, instead of the sulfonamido group, contain a methoxycarbonyl, 2-methoxyethoxycarbonyl or acetylamino or vinysulfonyl group.

In addition, substituted aminocoumarins, for example, 4-methyl-7-dimethylamino-coumarin or 4-methyl-7-diethylaminocoumarin, are useful. Further, the compounds 1-(2-benzimidazolyl)-2-(1-hydroxyethyl-2-benzimidazolyl)-ethylene and 1-ethyl-3-phenyl-7-diethylamino-carbostyril are useful as polyamide brighteners. The compounds 2,5-di-(2-benzoxazolyl)-thiophene, 2-(2-benzoxyazolyl)-naphtho-[2,3-b]-thiophene and 1,2-di-(5-methyl-2-benzoxazolyl)-ethylene are suitable as brighteners for polyester and polyamide fibers. Brighteners of the substituted 4,4'-diphenylstyril type such as 4,4'-bis (4-chloro-3-sulfostyryl)-diphenyl may also be present. Mixtures of the above-mentioned brighteners may also be used.

Enzymes which may be embedded in the enveloping material mixture of the invention are mostly from the class of proteases, lipases and amylases or their mixtures. Enzymic substances obtained from strains of bacteria or fungi, such as Bacillus subtilis, Bacillus licheniformis and Streptomyces griseus are specially suitable. These latter are relatively resistant to alkalis, percompounds, and anionic surface-active compounds and are still active at temperatures up to 70°C. Suitable are also combinations of enzymes from different sources, especially combinations of proteases and amylases.

Manufactures sell enzyme preparations mostly as aqueous solutions of the active substances or as powders, granulates, or as cold-sprayed products. The latter are often diluted with sodium chloride, alkali metal orthophosphates, pyrophosphates or polyphosphates, calcium, and magnesium salts as well as with antidust oily or paste-like non-ionic surface-active compounds. These ingredients do not impair the properties of the compositions according to the invention.

The enzyme content of the particulate detergent additives should not exceed 75% by weight. Preferably, it is 1% to 60% by weight.

Suitable biocides are halogenated carbanilides, halogenated salicylanilides, halogenated diphenylmethanes, halogenated diphenyl ethers, and halogenated diphenyl sulfides, furthermore, substituted thiuram disulfides, and pyridinethiones. Examples are 2,2-dihydroxy-3,3',5,5'6,6'-hexachlorodiphenylmethane, 2,2'-dihydroxy-3,3'5,5'-tetrachlorodiphenylmethane, 2,2'-dihydroxy-3,3'-dibromo-5,5'-dichlorodiphenylmethane, 2,2'-dihydroxy-3,3',5,5'-tetrachlorodiphenyl sulfide, 2-hydroxy-4,4'-dichlorodiphenyl ether, 2-hydroxy-4,2',4'-trichlorodiphenyl ether, and 2-hydroxy-3,5,5'-tribromodiphenyl ether.

Of the above-named active agents, several can be simultaneously present in the particulate detergent additives, for example, optical brighteners together with enzymes or biocides. It is preferable not to use bleaching activators mixed with other active substances in order to avoid immediate contact with the latter.

Advantageously, the particulate detergent additives should not contain more than 60% by weight of optical brighteners and biocides. Preferably, this content is 1 to 40%.

The particles composed of the components (A), (B), (C), and the above-named active agents can be present in the form of flakes, needles, small moldings, or granulates having a diameter which on the average, should be 0.1 mm to 1.0 mm. Such particles can be manufactured by methods known per se, for example, by rolling, extruding, or granulating, optionally followed by grinding and screening out the particles which are too fine or too coarse. Suitable are, for example, the conventional installations which are used in the soap industry for the manufacture of soap powders, soap flakes or needle-shaped soap chips. Furthermore, extruded, cylindrical, needle-shaped, or irregularly shaped particles can be worked in tumbling barrels to form almost spherical particles whereby the surface is reduced, resulting in greater stability in storage. It is preferred that the particles of the invention should be present approximately in drop to globular shape and at least 70% by weight should have a diameter with the range of 0.1 mm to 1 mm, preferably more than 90% by weight, should have an average diameter of 0.1 mm to 1 mm. Their composition should be largely homogeneous, and the surface should be smooth. Powder particles which fulfill these requirements are obtainable by homogenizing the active agent and the other components at a temperature which lies above the melting points of the components (A) and (B) and preferably below the melting point of the active agent or material and spraying, for example, by means of a nozzle under high pressure or by a spray disc into a fall space, in which the temperature lies below that of the solidifying point of the enveloping material mixture.

Preferably the stabilized detergent additive is produced by a process which consists of dispersing solid particles of said active material in a melt of said enveloping material mixture, forming droplets of said dispersion at least 70% of which have a diameter within the range of 0.1 mm to 1 mm, by means selected from the group consisting of (1) pressure spraying through a nozzle having an opening having a diameter of from 0.3 mm to 2.5 mm at a pressure of from 10 to 30 kg/cm$^2$ and (2) spraying from a spray disc rotating at a peripheral speed of from 5 to 150 m/sec., and cooling said droplets without contact below their solidifying temperature.

When a spray nozzle is used, the aperature of the spray nozzle whould have a diameter of 0.3 mm to 2.5 mm, preferably 0.6 mm to 1.8 mm. The pressure with which the dispersed melt is fed to the nozzle should amount to 10 to 30, preferably 15 to 25, kg/cm$^2$. Instead of a nozzle, a rotating spray disc, which may be provided with round or slot-like orifices, may also be used. The peripheral speed of such a disc, which has usually a diameter of 150 to 300 mm, and rotates at 800 to 10,000 revolutions per minute, should be 5 to 150 m/sec., preferably 10 to 100 m/sec. The fall space, in which the sprayed particles solidify, suitably consists of a cylindrical chamber, which is fitted with supply lines for cooling air and a discharge device for the powder, arranged at the conical base of the chamber. The cooling air, the temperature of which lies at least 10°C below the solidifying temperature of the enveloping material mixture and, for example, ranges from −10° to +30°C, and preferably does not exceed 25°C may be led in the same direction or countercurrent.

When technically pure starting materials are used, the sprayed particles may be naturally colored. By addition of dyestuffs or colored pigments before the spraying or dusting of the grains obtained with pigments, for example, titanium oxide, the natural color may be masked or altered.

The stabilized detergent additive of the invention may be present alone, in admixture with percompounds or in admixture with pulverulent to granular washing compositions with or without bleaching agents. Especially suitable are mixtures with pulverulent to granular washing compositions having a particle size corresponding to that of the detergent additives of the invention.

These washing compositions usually contain at least one compound from the class of anionic, amphoteric and non-ionic surface-active compounds, at least one compound from the class of polymeric phosphates, sequestering agents and washing alkalis and at least one compound from the class of soil suspending agents.

In addition to alkali metal peroxides, the most suitable percompounds which liberate hydrogen peroxide in aqueous solution are the perhydrates, for example, anhydrous or crystalline sodium perborate, also alkali metal percarbonates, perpyrophosphates and persilicates and urea perhydrate. Sodium perborate tetrahydrate is preferably used.

In such mixtures having a bleaching effect, the detergent additives according to the invention show high stability in storage. If necessary, several additives according to the invention having different composition and different content of active agent can be added to the detergents compositions.

Preparations which comprise substantially the stabilized bleaching assistant, are suitable for use in the textile industry or in industrial laundries, where they are used together with hydrogen peroxide or solid per compounds and possibly the usual additions for the preparation of the bleaching baths and bleaching washing baths.

If, in addition to the stabilized bleaching assistant, according to the invention, the compositions of the invention contain other constituents usually present in bleaching baths, the composition of such preparation lies approximately in the range of the following formulation:

| | |
|---|---|
| 5% to 95%, | preferably 7% to 50%, by weight of a stabilized bleaching assistant defined above, |
| 95% to 5%, | preferably 93% to 50%, by weight of neutral and/or preferably alkaline-reacting builder salts and possibly other constituents usual in bleaching or bleaching washing compositions, such as, for example, surface-active compounds, soil suspension agents, foam stabilizers, dyestuffs and perfumes and so forth. |

When in the above formulation the inorganic builder salts are wholly or partly replaced and present as percompounds yielding $H_2O_2$ in aqueous solution, the preparations according to the invention represent specially interesting bleaching compositions for practical purposes, which on dissolving in water give cold-bleaching washing liquors, in which the active oxygen is already effective a at temperatures from 20° to 70°C, especially 30° to 60°C.

In such bleaching compositions the ratio of the activator in the stabilized bleaching assistant of the invention to the percompound is always such that from 0.05 to 2 mols, preferably 0.1 to 1 mol, of activator is present per gram-atom of active oxygen of the percompound.

When such bleaching compositions contain more than 40% by weight of activator and percompound, this quantity relating to the pure activator and the pure percompound without the other constituents of the stabilized bleaching assistant, these preparations are preferably used as bleaching agent concentrates in the textile industry or in industrial laundries.

When the bleaching compositions of the invention contain up to 40% by weight of pure activator and percompound in the above-defined ratios, they are useful as bleaching washing compositions and washing assistants, which are of special practical interest and, therefore, represent a preferred field of application of the present invention. In such bleaching washing compositions and washing assistants, the proportions of activator and percompound constitute together mostly from 5% to 40%, especially from 10% to 35%, by weight of the composition. The composition of such bleaching agents generally lies within the range of the following formulation, the constituents of the granulate of the above-defined activator component being distributed according to the formulation in the various categories listed below:

| | |
|---|---|
| 5% to 40%, | preferably 7% to 30% by weight of a surface active component, containing at least one surface-active compound of the type of the sulfonates, sulfates, soaps, non-ionics and, optionally, one or more of the following substances: |
| 0 to 10%, | preferably 0.5% to 8%, by weight of foam stabilizers, |
| 0 to 10%, | preferably 0.5% to 8%, by weight of non-surface-active foam inhibitors, |
| 5% to 40%, | preferably 10% to 35%, by weight of pure activator and percompound, |
| 10% to 80%, | preferably 35% to 75%, by weight of builder salts, these substances being preferably alkaline-reacting and the amount of these substances preferably constituting 0.5 to 7 times, and especially 1 to 5 times, the total amount of surface-active compounds, and |
| 0 to 30%, | preferably 3% to 15%, by weight of other bleaching and washing compositions constituents such as, for example, soil suspension agents, textile softeners, enzymes, optical brighteners, dyestuffs and perfumes, water, |

where the activator in the above-defined stabilized bleaching assistant is present in an amount corresponding to 0.05 to 2 mols, preferably 0.1 to 1 mol per gram-atom of active oxygen of the percompound.

In this general formulation are also included bleaching fine washing compositions to be used at temperatures up to 70°C, the surface-active compound content of which is generally in the range from 8% to 40%, preferably 12% to 40%, by weight. Provided these fine washing compositions are not intended for use in washing machines, especially in drum washing machines, they need not also contain foam inhibitors. Bleaching softening or after-rinsing compositions have usually a surface-active compound content of less than 5% by weight, and they also need not contain foam inhibitors.

The bleaching washing compositions intended for use in washing machines, preferably in drum washing machines, are of particular practical importance in which the surface-active compound component constitutes usually 7% to 30% by weight. These mostly contain at least one of the following two types of surface-active compound in the amounts there indicated;

| | |
|---|---|
| 15% to 100%, | preferably 35% to 90%, by weight of a sulfonate and/or a sulfate with preferably 8 to 18 carbon atoms in the hydrophobic residue, |
| 10% to 60%, | preferably 10% to 50%, by weight of non-ionics and optionally one or more of the following substances: |
| 5% to 70%, | preferably 10% to 60%, by weight of a soap, |
| 0 to 10%, | preferably 0.5% to 8%, by weight of a foam stabilizer, |
| 0 to 10%, | preferably 0.5% to 8%, by weight of a non-surface-active foam inhibitor, |

the foaming power, however, of the surface-active component being reduced either by simultaneous presence of different surface-active compounds reducing the foaming power and/or foam-inhibiting soap and/or non-surface-active foam inhibitors.

The said bleaching washing compositions are generally prepared by mixing the stabilized bleaching assistant according to the invention with granular percompounds and washing compositions which have been obtained by admixing a washing composition powder prepared by hot spray drying. Such cold-bleaching washing compositions are marked by a good stability on storage.

The further constituents of the compositions according to the invention are described below in more detail according to the class of substance.

Suitable detergent substances which may be used in the washing agent-containing powder components are those anionic surface-active compounds of the sulfonate or sulfate type, for example, alkylbenzenesulfonates, especially n-dodecylbenzenesulfonate, and also olefinsulfonates, such as are obtained, for example, by sulfonation of primary or secondary aliphatic monoolefins with gaseous sulfur trioxide and subsequent alkaline or acid hydrolysis, as well as alkylsulfonates, such as are obtainable from n-alkanes by sulfochlorination or sulfoxidation and subsequent hydrolysis or neutralization, or by addition of bisulfite to olefins. Further, a-sulfo-fatty acid esters, primary and secondary alkylsulfates, and the sulfates of ethoxylated or propoxylated higher molecular weight alcohols and alkylphenols are suitable.

Further suitable anionic surface-active compounds are alkali metal soaps from fatty acids of natural or synthetic origin, for example, the sodium soaps of coconut, palm kernel or tallow fatty acids. Suitable amphoteric surface-active compounds are alkylpetaines and especially alkylsulfobetaines, for example, 3-(N,N-dimethyl-N-alkyl-ammonium)-propane-1-sulfonate and 3-(N,N-dimethyl-N-alkyl-ammonium)-2-hydroxypropane-1-sulfonate.

The anionic surface-active compounds may be present as the alkali metal salts such as the sodium and potassium salts and ammonium salts as well as salts of organic bases, for example, lower alkanolamines, such as mono-, di- or tri-ethanolamines. If the said anionic and amphoteric compounds contain an aliphatic hydrocarbon residue, this should preferably have a straight chain and contain 8 to 22 carbon atoms. In the compounds with an araliphatic hydrocarbon residue, the preferably unbranched alkyl chains contain an average of 6 to 16 carbon atoms.

The most important non-ionic surface-active compounds are the polyglycolether derivatives of alcohols, fatty acids and alkylphenols, which contain 3 to 30 ethoxy units, and 8 to 20 carbon atoms in the hydrocarbon residue. Polyglycolether derivatives are particularly suitable in which the number of ethoxy units amounts to 5 to 15 and the hydrocarbon residues of which are derived from straight-chain primary alkanols having 12 to 18 carbon atoms or from alkylphenols having a straight alkyl chain having 6 to 14 carbon atoms.

Further suitable non-ionic surface-active compounds are the water-soluble polyethyleneoxide adducts to polypropyleneglycol, ethylenediaminepolypropyleneglycol and alkylenepolypropyleneglycol with 1 to 10 carbon atoms in the alkylene chain, which adducts contain 20 to 250 ethoxy units and 10 to 100 propoxy units. The said compounds usually contain 1 to 5 ethoxy units per propoxy unit. Non-ionic ocmpounds of the amineoxide and sulfoxide type, which may possibly also be ethoxylated, are also utilizable.

In addition, alkali metal polymeric phosphates may be contained in the powder component containing washing agents, especially pentasodium tripolyphosphate. The tripolyphosphates may also be present in admixture with higher condensed phosphates, such as tetrapolyphosphates, or their hydrolysis products, such as acid or neutral pyrophosphates.

The condensed phosphates may also be replaced wholly or partly be sequestering agents, for example, aminopolycarboxylic acids and their alkali metal salts. These include especially alkali metal salts of nitrilotriacetic acid and ethylenediaminetetraacetic acid. Further, the salts of diethylenetriamine-pentaacetic acid and the higher homologs of the said aminopolycarboxylic acids are suitable. These homologs may be prepared, for example, by polymerization of an ester, amide or nitrile of N-acetic acid-aziridine and subsequent saponification to give carboxylic acid salts or by reaction of polyamines such as polyethyleneimine with a molecular weight of 500 to 10,000 with salts of chloroacetic acids or bromoacetic acids in alkaline medium. Further suitable aminopolycarboxylic acids are poly-(N-succinic acid)-ethyleneimine and poly-(N-tricarballylic acid)-ethyleneimine of average molecular weight 500 to 500,00, which are obtainable similarly to the N-acetic acid derivatives.

Further, nitrogen-free compounds may be used as sequestering agents, for example, the water-soluble alkali metal salts, such as potassium and especially sodium salts of polyvalent hydroxycarboxylic acids or ethercarboxylic acids, such as citric acid, gluconic acid, glucuronic acid and hydroxydiacetic acid, as well as of higher molecular weight polycarboxylic acids, for example, of polymerizates of ethylenic mono-, di- and tricarboxylic acids, such as acrylic acid, maleic acid, fumaric acid, itaconic acid, citric acid, aconitic acid, mesaconic acid and methylenemalonic acid. Copolymerizates of these carboxylic acids with one another or with other copolymerizable substances as, for example, ethylenically unsaturated hydrocarbons, such as ethylene, propylene, isobutylene and styrene, with ethylenic monocarboxylic acids, such as acrylic acid, methacrylic acid, crotonic acid and 3-butenecarboxylic acid or with other ethylenically unsaturated alcohols, ethers, esters, amides and nitriles, such as vinyl alcohol, allyl alcohol, vinylmethylether, acrolein, vinyl acetate, acrylamide and acrylonitrile, can also be used. Copolymerizates from ethylenic mono-, di- and tri- carboxylic acids and several ethylenically unsaturated compounds of different structure are also suitable. The polymerizates and copolymerizates have an average degree of polymerization of 3 to 6,00 and should contain 1 to 9, preferably 2 to 9, carboxyl groups capable of forming salts, for every 3 monomer units.

So-called washing alkalis may be mentioned as further builder salts, such as the alkali metal silicates, especially sodium silicate, in which the ratio of $Na_2O$ to $SiO_2$ amounts to 1:3.5 to 1:1, and also carbonates, bicarbonates and borates of alkali metals such as sodium or potassium. The amount of alkaline-reacting substances including the washing alkalis and phosphates should be such that the pH value of a usable alkali liquor amounts of 9 to 11 and during the washing process does not fall below values under 8 on account of consumption of alkali through the hydrolysis of the bleaching activator.

Increased effects may in many cases be obtained by suitable combination of different surface-active washing substances or builder salts with one another, for example, an improved washing powder or a reduced foaming capacity. Such improvements are possible, for example, by combination of anionic with non-ionic and/or amphoteric surface-active compounds with one another or by mixing washing substances of the same type, which differ with respect to their structure in the number of carbon atoms, the number and position of the double bonds or chain branchings in the hydrocarbon residue. Mixtures of inorganic and organic builder salts with a synergistic action may be used or may be combined with the above-mention mixtures.

The washing compositions may also contain optical brighteners, either embedded as described above or in the other constituents of the compositions. Other constituents which may be contained in the powder components containing washing agents are neutral salts, especially sodium sulfate, antimicrobial substances, such as halogenated phenolethers and thioethers, halogenated carbanilides and salicylanilides, as well as halogenated diphenylmethanes, also stabilizing agents for percompounds, such as magnesium silicate.

For increasing the dirt-carrying capacity, known greying inhibitors or soil-suspending compounds, especially sodium cellulose glycollate (carboxymethylcellulose) are added.

If desired, the washing compositions may contain known foam-inhibiting means, such as saturated fatty acids or their alkali metal soaps with 20 to 24 carbon atoms, higher molecular weight fatty acid esters or triglycerides, trialkylmelamines or dialkyl and tetraalkyl ureas.

The constituents contained in the powder component containing washing agent may be contained in homogeneously composed powder particles. Such powder particles are obtainable, for example, by spray drying or granulation from aqueous concentrates or granulating the remaining constituents on previously formed powders in a known way. The powder component containing washing agent, however, may also consist of g granular mixtures, in which the powder particles have a variable composition. Thus, for example, a specified fraction of the powder particles may contain the detergent substances and a part of the builder salts and have been obtained by hot spray drying, while a further part of the particles prepared, for example, by granulation, contains the residue of the builder salts and those active substances with decompose, volatilize or lose activity under the conditions of the hot spray drying as, for example, perfumes, biocides and certain foam inhibitors.

In the complex mixtures, the proportion by weight of the powder component containing washing agent to the sum of the stabilized bleaching assistant, according to the invention, and percompound should amount to 1:2 to 10:1, preferably 1:1 to 5:1.

The particulate detergent additives according to the invention as well as their mixtures with percompounds and/or washing agents are marked by a very high stability on storage, i.e., the embedded active agent does not lose its activity even on prolonged storage. On application the mixtures show excellent solubility properties, i.e., they are dissolved without residue within a short time on use even in cold water or cold washing liquors. The dissolution proceeds considerably faster than in the case of enveloping mixtures which do not contain component (C). This was all the more surprising since neither the fatty acid nor the alcohol of component (A) are sufficiently quickly soluble in cold alkali solutions. If, therefore, fatty acid or higher melting fatty alcohols are used alone as coating substances for the bleaching activators, under the same conditions, no solution or only very slow solution takes place. On the other hand, the water-soluble ethoxylated alcohols of component (B) are unsuitable as coating substances, since they do not improve the stability on storage of the bleaching activators.

The preparation of the powder particles is particularly simple in comparison with the known process, in which the bleaching activators are granulated or coated with coating substances, since the use of solvents for the powders and a recovery of the solvents, always combined with losses, is omitted.

In addition the polymers of component (C) of the enveloping material mixture of the invention possess advantageous detergent properties. They are capable of binding part of the calcium hardness of water and of counteracting incrustation of the fiber, especially when detergents poor in phosphate are used. The polymers are insoluble in water, however, when they are swollen, they do not adhere to the textile fiber, but are completely washed away during the rinsing.

The present invention will be further described with reference to the following specific Examples which are not to be deemed limitative of the invention.

EXAMPLES 1 – 6 a. Manufacture of the Copolymers of Component (C)

I. For the emulsification of 2.6 parts by weight of acrylic acid in 30 parts by weight of water, 0.14 part by weight of a 40% by weight aqueous solution of sulfonated castor oil were employed, 0.6 parts by weight of ethylene glycol diacrylate, 0.035 parts by weight of benzoin methyl ether, and 1 part by weight of a 40% emulsion of a copolymer of 50% butyl acrylate, 45% styrene, and 5% acrylic acid were added to the emulsion under agitation. About a 5 mm thick layer of the dispersion produced was poured on a metal surface which has been cooled to −15°C. After the dispersion has solidified, it was irradiated for 10 minutes with an UV-light source (Philips blacklight lamp TL 40 W/0.8), set up in a distance of 25 cm. The solidified structure was thawed, neutralized with 0.1 N NaOH, washed with deionized water, and dried in flowing air at 60°C to 80°C. Next, the material was preliminarily crushed in a breaker and then ground in a colloid mill to obtain an average particle of 0.05 mm. The particles having a size of more than 0.1 mm were screened out. The weight per liter of the polymer was 420 g and the water absorption powder amounted to 800% by weight, based on the anhydrous polymer.

II. 0.14 parts by weight of sulfonated castor oil dissolved in 0.16 parts of weight of water and 1.2 parts by weight of polyacrylic acid, were dissolved in 30 parts by weight of water. After the addition of 0.23 parts by weight of hexamethylene diacrylamide, 0.035 parts by weight of benzoin isopropyl ether, and 2.3 parts by weight of acrylic acid, the dispersion was transferred to a cooled trough and polymerized by irradiation with a UV-lamp as described above. The polymer was washed, dried, and comminuted to a particle size of 0.05 mm. After the particles having a size above 0.1 mm has been screened out, the water absorption powder of the particles amounted to 3,200% by weight, based on the dry weight.

b. Manufacture of the Detergent Additive

According to the composition listed in Table I, below, saturated fatty acids or fatty alcohols, component (A), were melted at 80°C together with polyoxyethylene glycol (molecular weight, 10,000; melting point, 63°C) or with sodium lauryl sulfate, component (B), and subsequently, the additions listed in Table I were dispersed therein. The melt was sprayed into a fall chamber through a nozzle having an orifice of 1.5 mm diameter under a pressure of 20 atmosphere. The temperature of the cooling air fed countercurrently was 19°C and that of the exiting air was 21°C. The spray products predominantly had a spherical shape and when subjected to a screening analysis gave the following distribution of particle size: over 1.6 mm = 2.5%; 1.2 − 0.2 mm = 97%; under 0.2 mm = 0.5%. The average particle size was 1.2 mm.

c. Test of the Dissolving Behavior

A laboratory washing machine (Launderometer) was used, the washing tube of which had a capacity of 1 liter. The tube was charged each time with 300 ml washing liquor which was prepared by using tap water of 16° German hardness for dissolving 1.4 gm/liter sodium peroxyborate and 5.6 gm/liter detergent having the following composition:

9.5% Sodium dodecylbenzensulfonate
3.5% Tallow fatty alcohol, ethoxylated tenfold
4.5% Sodium soap (tallow fatty acid-behenate 1:1)
50.0% Pentasodium tripolyphosphate
8.0% Sodium carbonate
5.0% Sodium silicate ($Na_2O : SiO_2 = 1 : 3.3$)
2.5% Maganesium silicate
1.5% Sodium carboxymethylcellulose
0.5% EDTA (Sodium salt)
0.3% Optical brightener
7.5% Sodium sulfate
7.2% Water The washing liquor was adjusted to a temperature of 20°C, then 0.7 gm of a detergent additive according to b) was added, and the machine was started. After 30 minutes, the machine was emptied, and the solution was filtered through a metal sieve with 0.1 mm width of mesh. The screen with the residue remaining thereupon was dried to constant weight and weighed. The part of the residue which is attributable to the water-insoluble component (C) was determined by a blank test. For this purpose, the same quantity of polymer as that contained in the spray product was introduced into the washing liquor and treated as described above. The blank value thus obtained was deducted from the result.

The results (average values of three tests) are summarized in Table I. The abbreviation TAGU stands for tetraacetylglycoluril. The polyacrylates I and II prepared according to the method a) were used as additives. In the comparative experiments, this additive was replaced by the corresponding quantity of TAGU. The compositions according to the invention possess considerably better dissolving behavior. Example 6 shows that the composition of the enveloping material according to the invention also proves itself when other active agents (enzymes) are used.

TABLE I

| Composition | Example 1 | 2 | 3 | 4 | 5 | 6 | Comparison 1–3 | 4–5 | 6 |
|---|---|---|---|---|---|---|---|---|---|
| % Palmitic Acid | 20 | 20 | 15 | 16.8 | 16.8 | 20 | 20 | 16.8 | 20 |
| % Stearic Acid | 5 | 5 | 10 | 16.8 | 16.8 | 20 | 5 | 16.8 | 20 |
| % Tallow Alcohol | — | — | — | 8.4 | 8.4 | 10 | — | 8.4 | 10 |
| % Polyglycol | 20 | 20 | 20 | — | — | — | 20 | — | — |
| % Na Lauryl Sulfate | — | — | — | 8 | 8 | 10 | — | 8 | 10 |
| % Polyacrylate I | 5 | — | — | 5 | — | — | — | — | — |
| % Polyacrylate II | — | 5 | 10 | — | 5 | 10 | — | — | — |
| % TAGU | 50 | 50 | 45 | 45 | 45 | — | 55 | 50 | — |
| % Protease | — | — | — | — | — | 30 | — | — | 40 |
| % Undissolved Part | 32 | 27 | 18 | 0 | 0 | 0 | 70 | 36 | 22 |

d) Test of the Stability in Storage

The following mixtures were prepared for the test of stability in storage:

20 parts by weight of the detergent additive according to Example 5 (*a*) were mixed with 10 parts by weight of sodium perborate tetrahydrate (*b*) having a weight per liter of 1000 gm and an average particle size of 0.3 mm, as well as with 63 parts by weight of a washing agent mixture (*c*) obtained by hot spray drying, having a weight per liter of 420 gm and an average particle size of 0.65 mm. The finished powder mixture had the following composition (data in weight percent):

| | | |
|---|---|---|
| (a) | 9.0% | tetraacetylglycoluril |
| | 6.72% | fatty acid |
| | 1.68% | tallow fatty alcohol |
| | 1.6% | Na-lauryl sulfate |
| | 1.0% | Polyacrylate II |
| (b) | 10.0% | sodium perborate tetrahydrate |
| (c) | 7.0% | n-dodecylbenzenesulfonate (Na-salt) |
| | 2.0% | oleyl alcohol with 10 ethoxy units |
| | 35.0% | pentasodium tripolyphosphate |
| | 6.0% | sodium carbonate |
| | 3.5% | sodium silicate ($Na_2O : SiO_2 = 1 : 2$) |
| | 2.5% | magnesium silicate |
| | 0.2% | Na-ethylenediaminetetraacetate |
| | 0.3% | optical brightener |
| | 1.0% | sodium carboxymethylcellulose |
| | 7.5% | water |

The mixture was filled into a folding box of 650 gm capacity and stored at 20°C and 70% relative air humidity. During the observation period of 10 weeks no decline in the available active oxygen took place.

For purposes of comparison the packets were stored at 30°C and 80% relative air humidity in a conditioning cabinet. A washing composition (A) of the same composition in which the tetraacetylglycoluril, however, was not melted with the powder particles but together with 10% by weight of sodium sulfate (as weight equalizer) and 10% sodium peroxyborate was admixed to the spray-dried detergent, to serve as a comparison.

In a second comparative experiment (B) a tetraacetylglycoluril coated with stearic acid was used, for the preparation of which, 75 gm of tetraacetylglycoluril on a granulation plate was sprayed with a solution of 25 gm of stearic acid in 75 gm of carbon tetrachloride and with the removal of the solvent, it was then after-granulated. The screen analyses for this granulate are:

over 1.6 mm = 1%; 1.6 mm to 0.2 mm = 55%;
below 0.2 mm = 44%.

The further comparative experiments C to E were also made. In Experiment C, corresponding to the method of operation given in the Example, 40 parts by weight of tetraacetylglycoluril were dispersed in 60 gm of molten polyoxyethyleneglycol of molecular weight 10,000 and sprayed. The screen analysis of the powder consisting of globular particles gave:

over 1.6 mm = 1%; 1.6 to 0.2 mm = 98%;
below 0.2 mm = 1%.

In the same way (Experiment D) 50 parts by weight of tetraacetylglycoluril were dispersed in a melt of 50 parts by weight of an adduct of coconut fatty alcohol (chain lengths $C_{12}$–$C_{16}$) adducted with 30 mol of ethylene oxide, and sprayed. In the comparative Experiment (E), instead of the ethoxylated coconut fatty alcohol, the same amont of stearic acid was used. The screen analysis led to the following results:

| Screen No. (mm) | Experiment D | Experiment E |
|---|---|---|
| over 1.6 | 1% | 1.0% |
| 1.6 to 0.2 | 97% | 96.3% |
| under 0.2 | 2% | 2.7% |

The fractional amount of the still active perborate was determined by titration at weekly intervals. The results are given in Table II

TABLE II

| Example | Component | % Perborate After Weeks 1 | 2 | 3 | 4 | 5 |
|---|---|---|---|---|---|---|
| 5 | (see Example) | 98 | 97 | 94 | 90 | 74 |
| A | — | 82 | 54 | 23 | 1 | — |
| B | Stearic Acid (coated) | 86 | 59 | 22 | 3 | — |
| C | Polyglycol (sprayed) | 90 | 65 | 20 | — | — |
| D | Ethoxylated Fatty Alcohol (sprayed) | 77 | 27 | 5 | — | — |
| E | Stearic Acid (sprayed) | 95 | 93 | 89 | 82 | 65 |

The comparative experiments show that the stability on storage of the compositions according to the invention is greater than that of the comparative samples A and B belonging to the state of the art. The same applied to the comparative samples C and D, in which known coating means were used. The comparative sample E, merely has similarly favorable storage properties. However, it was shown by means of the following experiment that the dissolving properties of the comparative samples E and also B are insufficient.

In a commercial washing machine (AEG-LAVAMAT) dark blue colored textiles of synthetic fibers were washed by the above described washing composition in the so-called "Protective Washing Process". 28 liters of washing liquor and 5 gm/liter of washing agent were used to 1 kg of dry laundry. The washing temperature was 30°C, the whole washing program with three rinses with clear water took 90 minutes. Inspection of the pieces of washed textiles showed that the textiles washed with the washing agent according to the invention were perfectly clean and had no residues of undissolved particles of washing agent. On the textiles which had been washed using a washing agent according to comparative experiment B and E, a large number of light colored particles had been deposited from the activator coated with fatty acid, which gave a speckled appearance to the textiles. Samples of washing liquors which had been poured through a hair sieve after the washing process left in the first case no residues, but with the comparative samples B and E distinct residues of undissolved particles were left on the sieve.

EXAMPLES 7 -9

As has been described in the preceding Examples 1 to 6 in Section B), the following mixtures were prepared by melting and spraying (EO means added ethylene oxide).

TABLE III

| | Examples 7 | 8 | 9 |
|---|---|---|---|
| TAGU | 45 | 50 | 50 |
| (A) Palmitic Acid | 18 | 15 | 15 |
| (A) Stearic Acid | 17 | 15 | 15 |
| (A) Tallow Fatty Alcohol | 10 | — | 7.5 |
| (B) Tallow Fatty Alcohol + 5 EO | — | 10 | — |
| (B) Na Coconut Fatty Alcohol Sulfate | 5 | — | 7.5 |
| (C) Polyacrylate II | 5 | 10 | 5 |

When the dissolving behavior was examined in the launderometer according to the method described for Examples 1 to 6 in Section C), the agents dissolved within 15 minutes in the detergent solutions which had been heated to 40°C so that no residues remained upon filtration through a screen having a width of mesh of 0.2 mm.

The preceding specific embodiments are illustrative of the practice of the invention. It is to be understood, however, that other expedients known to those skilled in the art or disclosed herein may be employed without departing from the spirit of the invention or the scope of the appended claims.

We claim:

1. A storage-stable, readily-soluble detergent additive comprising drop-shaped to globular shaped particles, at least 70% of which have a diameter within the range of 0.1 mm to 1 mm consisting of from 1% to 75% by weight of at least one active material enhancing the washing, bleaching or biocidal effects of a detergent selected from the group consisting of (1) 10% to 70% by weight of at least one compound selected from the groups consisting of N-acyl and O-acyl compounds, carbonic acid esters and pyrocarbonic acid esters which act as an activator for percompounds, the activation value of which for the percompounds amounts to more than 3 in the Per-Acid Formation Test, (2) 1% to 75% by weight of at least one enzyme selected from the group consisting of proteases, amylases, lipases and mixtures thereof, (3) 1% to 60% by weight of at least one optical brighteners, (4) 1% to 60% by weight of at least one biocide and (5) 1% to 30% by weight of at least one perfume or odorant, said at least one active material being substantially surrounded by and embedded in from 25% to 99% by weight of an enveloping material consisting of a mixture of A. from 20% to 90% by weight of said mixture of at least one compound having a melting point above 30°C, selected from the group consisting of (i) saturated fatty acids having from 10 to 24 carbon atoms, saturated hydroxyfatty acids having from 10 to 24 carbon atoms and mixtures of said fatty acids and hydroxyfatty acids with up to 20% by weight of unsaturated higher fatty acids and saturated fatty acids having 8 to 10 carbons, (ii) saturated fatty alcohols having from 12 to 24 carbon atoms, and (iii) mixtures of said acids (i) and said alcohols (ii) in a weight ratio of from 4:1 to 1:1, B. from 10% to 40% by weight of said mixtures of at least one water-soluble compound having a melting point above 30°C, selected from the group consisting of poly-oxy-lower alkylene glycols having a molecular weight of from 1,000 to 20,000, non-ionic surface-active compounds and anionic surface-active compounds of the sulfonate and sulfate types, said components (A) and (B) being present in a weight ratio of from 10:1 to 1:2, and C. from 1% to 40% by weight of said mixture of at least one water-unsoluble, but water swellable compound capable of absorbing more than 500% by weight of water, based on its dry weight, and having an average particle size in the range of from 0.001 mm to 1 mm, selected from the group consisting of (a) the alkali metal salts of copolymers of acrylic acid and from 2 to 25 mol percent of cross-linking monomers copolymerizable with acrylic acid and having more than one polymerizable double bond, (b) the alkali metal salts of copolymers of methacrylic acid and from 2 to 25 mol percent of cross-linking monomers copolymerizable with methacrylic acid and having more than one polymerizable double bond, and (c) mixtures of said salts.

2. The detergent additive of claim 1 wherein said component (C) has an average particle size of from 0.01 mm to 0.3 mm.

3. The detergent additive of claim 1 wherein said ratio of component (A) to component (B) is from 5:1 to 1:1.

4. The detergent additive of claim 1 wherein the mixture of components (A) and (B) has a melting point of above 38°C.

5. The detergent additive of claim 1 wherein component (B) is a poly-oxyethylene glycol having a molecular weight of from 2,000 to 10,000.

6. The detergent additive of claim 1 wherein component (B) is an anionic surface-active compound selected from the group consisting of a saturated fatty alcohol sulfate having from 12 to 18 carbon atoms, an unsaturated fatty alcohol sulfate having from 12 to 18 carbon atoms, a fatty alcohol ether sulfate having 12 to 18 carbon atoms in the fatty alcohol and 1 to 4 ethylene glycol ether groups, and an unsaturated fatty alcohol ether sulfate having 12 to 18 carbon atoms in the fatty alcohol and 1 to 4 ethylene glycol ether groups.

7. The detergent additive of claim 1 wherein the component (B) is a non-ionic surface-active compound selected from the group consisting of water-soluble poly-oxy-lower alkylene glycol monoethers having 3 to 100 oxy-lower alkylene units with compounds having 8 to 20 carbon atoms in a hydrocarbon chain selected from the group consisting of monohydric alcohols, alkanediols, fatty acids, fatty acid amides and alkylphenols.

8. The detergent additive of claim 7 wherein component (B) is selected from the group consisting of polyoxyethylene glycol monoethers having from 5 to 80 oxyethylene units with straight-chained primary hydrocarbon alcohols having 12 to 18 carbon atoms and alkylphenols having a straight alkyl chain with 8 to 12 carbon atoms.

9. A stabilized bleaching assistant suitable for use in pulverulent washing and bleaching compositions comprising drop-shaped to globular-shaped particles at least 70% of which have a diameter within the range of 0.1 mm to 1 mm consisting essentially of 10% to 70% by weight of at least one activator for active oxygen derived from compounds yielding $H_2O_2$ in aqueous solutions having an activating action of least 3 in the Per-Acid Formation Test selected from the group consisting of N-acyl compounds having 2 to 9 carbon atoms in the acyl, O-acyl compounds having 2 to 9 carbon atoms in the acyl, carbonic acid esters and pyrocarbonic acid esters, substantially surrounded by from 30% to 90% by weight of an enveloping material consisting of a mixture of A. from 20% to 90% by weight of said mixture of at least one compound having a melting point above 30°C, selected from the group consisting of (i) saturated fatty acids having from 10 to 24 carbon atoms, saturated hydroxy-fatty acids having from 10 to 24 carbon atoms and mixtures of said fatty acids and hydroxyfatty acids with up to 20% by weight of unsaturated higher fatty acids and saturated fatty acids having 8 to 10 carbon atoms, (ii) saturated fatty alcohols having from 12 to 24 carbon atoms, and (iii) mixtures of said acids (i) and said alcohols (ii) in a weight ratio of from 4:1 to 1:1, B. from 10% to 40% by weight of said mixture of at least one water-soluble compound having a melting point above 30°C, selected from the group consisting of poly-oxy-lower alkylene glycols having a molecular weight of from 1000 to 20,000, nonionic surface-active compounds and anionic surface-active compounds of the sulfonate and sulfate types, said components (A) and (B) being present in a weight ratio of from 10:1 to 1:2, and C. from 1% to 40% by weight of said mixture of at least one water-unsoluble, but water swellable compound capable of absorbing more than 500% by weight of water, based on its dry weight, and having an average particle size in the range of from 0.001 mm to 1 mm, selected from the group consisting of (a) the alkali metal salts of copolymers of acrylic acid and from 2 to 25 mol percent of cross-linking monomers copolymerizable with acrylic acid and having more than one polymerizale double bond, (b) the alkali metal salts of copolymers of methacrylic acid and from 2 to 25 mol percent of cross-linking monomers copolymerizable with methacrylic acid and having more than one polymerizable double bond, and (c) mixtures of said salts.

10. The stabilized bleaching assistant of claim 9 wherein said activator for active oxygen is present in an amount of from 30% to 60% by weight.

11. The stabilized bleaching assistant of claim 10 wherein said activator of active oxygen is tetraacetylglycoluril.

12. A washing and bleaching agent consisting of (I) from 5% to 95% by weight of said stabilized bleaching assistant of claim 10, and (II) from 5% to 95% by weight of at least one compound selected from the group consisting of (a) alkali metal builder salts, (b) percompounds giving $H_2O_2$ in aqueous solutions and stabilizers for percompounds, (c) tensides selected from the group consisting of anionic surface-active compounds, non-ionic surface-active compounds and amphoteric surface-active compounds, (d) optical brighteners, (e) water-soluble organic builder salts, (f) antimicrobial agents, (g) soil suspension agents, (h) enzymes, (i) foam stabilizers, (j) non-surface-active foam inhibitors, (k) textile softeners, and (l) corrosion inhibitors.

13. The washing and bleaching agent of claim 12 wherein said component II comprises a granular to pulverulent percompound, which liberates hydrogen peroxide in aqueous solution, the ratio by weight of the assistant to the percompound being 1:5 to 5:1 and is chosen so that 0.05 to 2 mols of activator are present per gram atom of active oxygen.

14. The washing and bleaching agent of claim 13 wherein said amount of said assistant is chosen so that 0.1 to 1 mol of activator are present per gram atom of active oxygen.

15. The washing and bleaching agent of claim 13 wherein said percompound is sodium perborate with or without water of crystallization.

16. A process for the production of the detergent additive of claim 1 which consists of dispersing solid particles of said active material in a melt of said enveloping material mixture, forming droplets of said dispersion at least 70% of which have a diameter within the range of 0.1 mm to 1 mm, by means selected from the group consisting of (1) pressure spraying through a nozzle having an opening having a diameter of from 0.3 mm to 2.5 mm at a pressure of from 10 to 30 kg/cm² and (2) spraying from a spray disc rotating at a peripheral speed of from 5 to 150 m/sec., and cooling said droplets without contact below their solidifying temperature.

* * * * *